United States Patent [19]

van den Berg

[11] 4,166,508

[45] Sep. 4, 1979

[54] METHOD AND A DEVICE FOR INTRODUCING A TUBULAR ASSEMBLY INTO THE SOIL

[75] Inventor: Arie P. van den Berg, Heerenveen, Netherlands

[73] Assignee: Ingenieursbureau A.P. van den Berg B.V., Heerenveen, Netherlands

[21] Appl. No.: 854,159

[22] Filed: Nov. 23, 1977

[30] Foreign Application Priority Data

Nov. 24, 1976 [NL] Netherlands ..... 7613060

[51] Int. Cl.[2] ..... E02D 3/10

[52] U.S. Cl. ..... 175/20; 52/108; 175/171; 175/320; 405/36; 405/50

[58] Field of Search ..... 175/103, 171, 57, 20, 175/320; 166/77; 173/DIG. 2, 90; 61/11; 52/108

[56] References Cited

U.S. PATENT DOCUMENTS

| | | | |
|---|---|---|---|
| 2,905,282 | 9/1959 | Miller | 52/108 |
| 3,032,151 | 5/1962 | Allen et al. | 52/108 |
| 3,208,478 | 9/1965 | Baines | 52/108 |
| 3,300,987 | 1/1967 | Maeda | 61/11 |
| 3,385,397 | 5/1968 | Robinsky | 52/108 |
| 3,503,164 | 3/1970 | Berry et al. | 52/108 |
| 3,859,798 | 1/1975 | Terashima et al. | 61/11 |
| 4,018,397 | 4/1977 | Rusch | 52/108 |

FOREIGN PATENT DOCUMENTS

| | | | |
|---|---|---|---|
| 1143879 | 5/1960 | Fed. Rep. of Germany | 175/171 |
| 1189492 | 3/1965 | Fed. Rep. of Germany | 175/57 |

*Primary Examiner*—William Pate, III

[57] ABSTRACT

A method and a device for introducing a tubular assembly into the soil, which assembly consists of two or more elongated strips with a curved cross-section, made of an elastically flexible material, which strips are unwound from corresponding drums and are being united at adjacent edges when being unwound, and are separated again when being rewound on said drums. The driving force is derived from the rotational movement of said drums. The assembly can be used for introducing drainage tape into the soil, for introducing a sounding probe into the soil, for cutting soil samples and for similar purposes.

21 Claims, 7 Drawing Figures

METHOD AND A DEVICE FOR INTRODUCING A TUBULAR ASSEMBLY INTO THE SOIL

Figure 1:
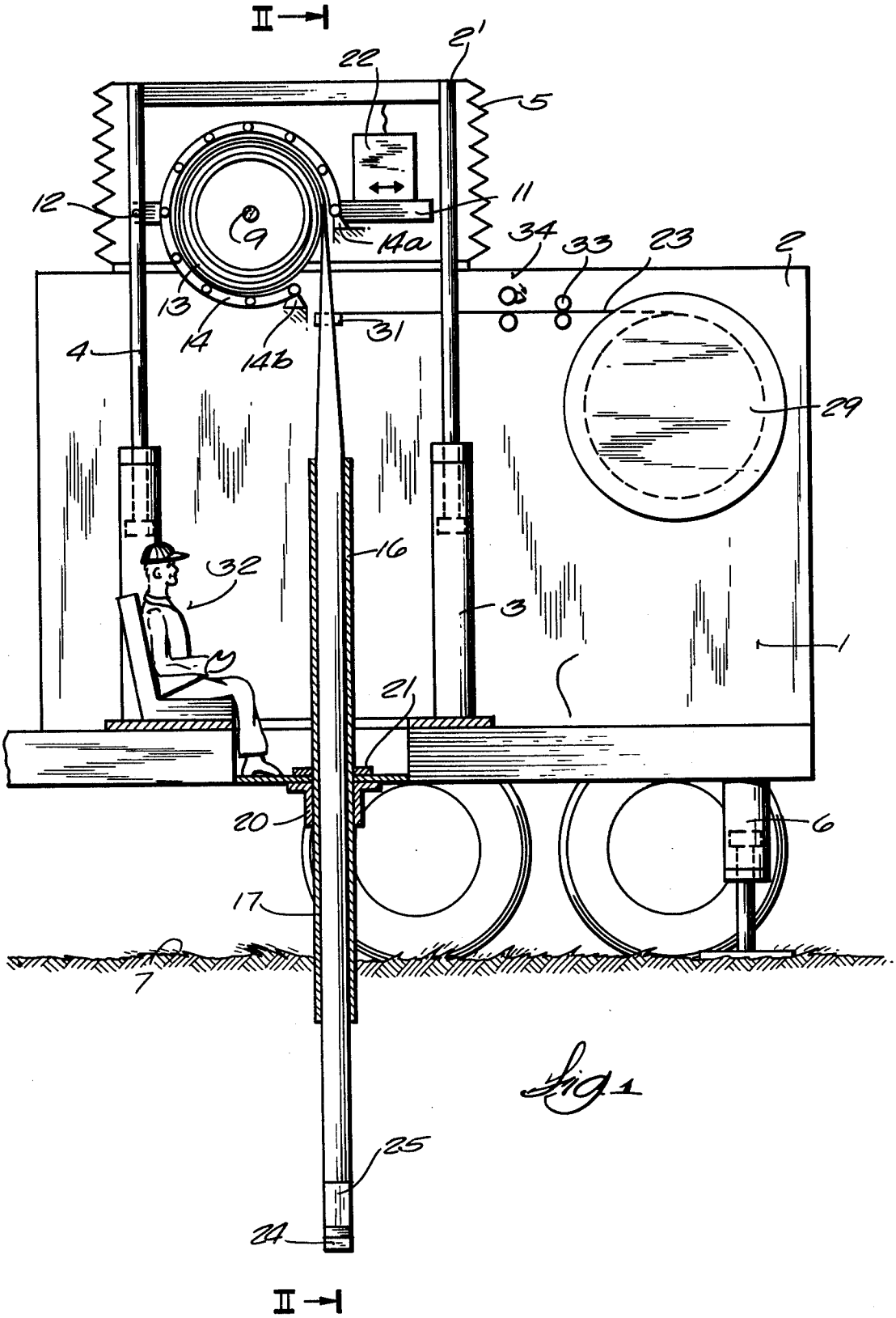

For several purposes it is necessary to drive a tube substantially vertically into the soil, e.g. for taking soil samples in order to determine the composition of the soil, for performing a soil sounding in order to determine the bearing capacity of the soil, or for introducing a vertical drainage, either by means of a so-called sand pile or by inserting a drainage tape consisting of a plastic strip with transversely protruding ribs and surrounded by a flat hose or sheath made of porous sheet material.

For both first-mentioned purposes it is usual to utilise relatively short tubes which are interconnected in series by means of screw connections as soon as the preceeding tubes have been pushed into the soil, so that a hydraulic press or ram with a restricted stroke length may be used. For the last-mentioned purpose generally a simple one-piece tube is used which is driven into the soil by means of a light pile driving rig. The draw-back of short tubes is that much time is lost during coupling and decoupling the tubes, and using a one-piece tube has the draw-back that such a tube is difficultly to be handled and transported, that, furthermore, erecting the driving rig is cumbersome, and that retracting a long tube from the soil is often very difficult.

The invention provides a method and a device which do not have the draw-backs of the known methods and devices. To that end the method of the invention is characterized in that at least two strips of an elastically flexible but in the extended condition rigid material, which are unwound from a drum, are combined and coupled with one another in such a manner that a rigid tubular assembly is obtained which, by exerting pressure in the axial direction of the assembly, can be driven into the soil. Guiding means may be used for guiding the assembly thus obtained into the soil, and in particular the drive of the drums on which these strips are wound can provide the force required for driving them into the soil, which may be facilitated by causing these strips to vibrate longitudinally.

The invention, furthermore, provides a device which is suitable for performing such a method.

This method and device may be used for sampling as well as for sounding purposes, but are especially suitable for inserting a drainage type which can be unwound from a reel together with the strips. In particular a shoe is arranged at the extremity of the strips which is driven into the soil by the assembly, but remains in the soil when said assembly is retracted. Since no long tubes, driving rigs or presses are required, such drainage tapes can be driven into the soil also in the horizontal direction.

After retracting the tubular assembly, the individual strips are again detached from one another, and are wound on the drums in question.

The method and device according to the invention are particularly suited for operating under water, since the means for unwinding and rewinding the strips can be posioned also upon the water bottom.

Figure 2:
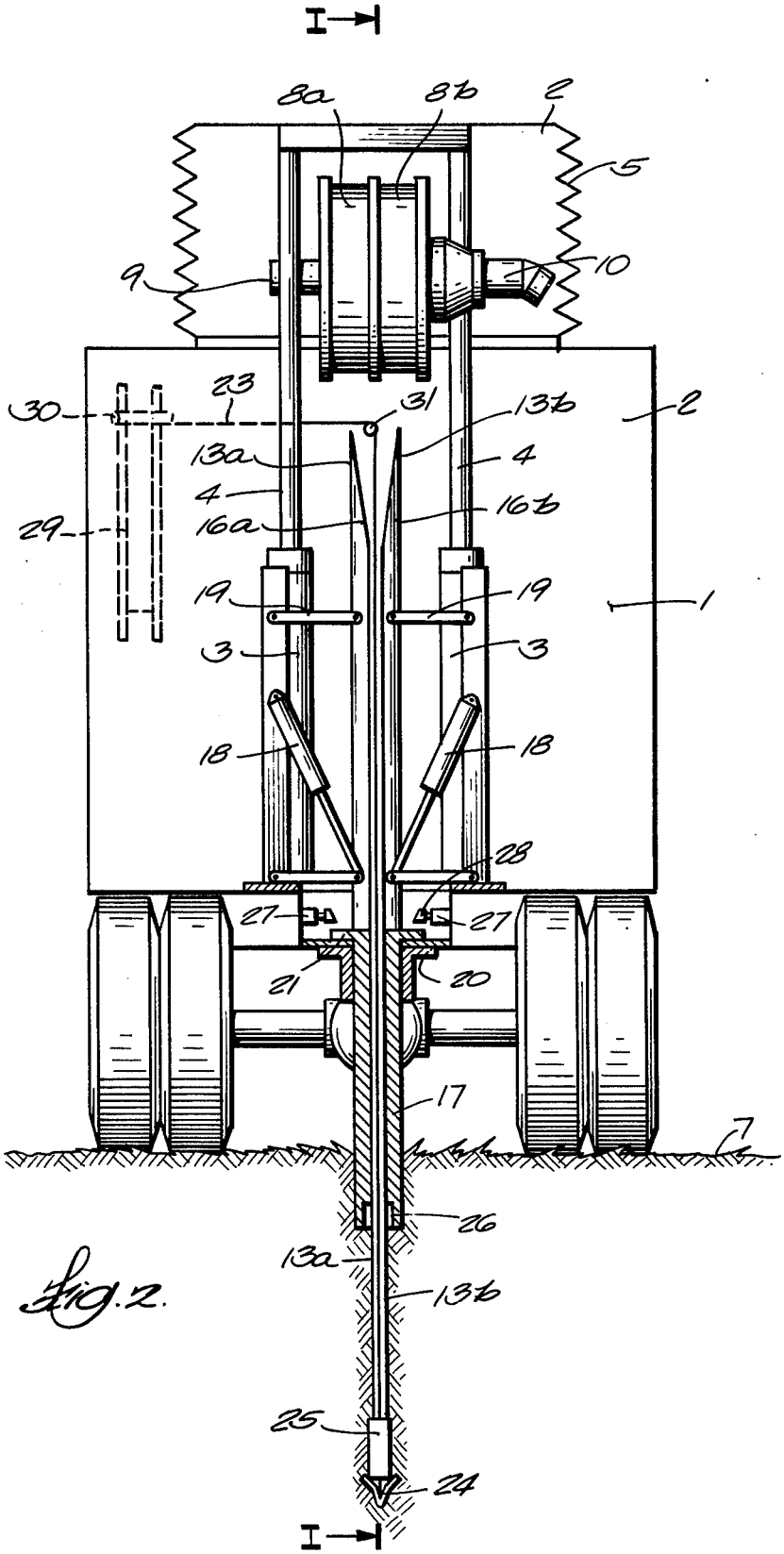
Figure 4:
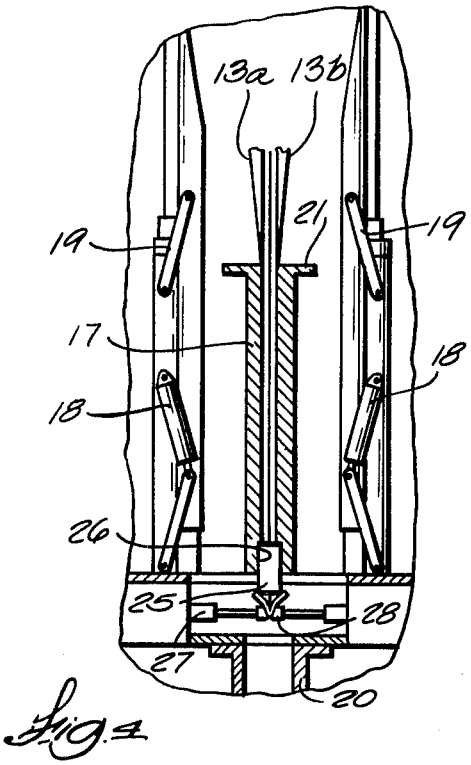
Figure 6:
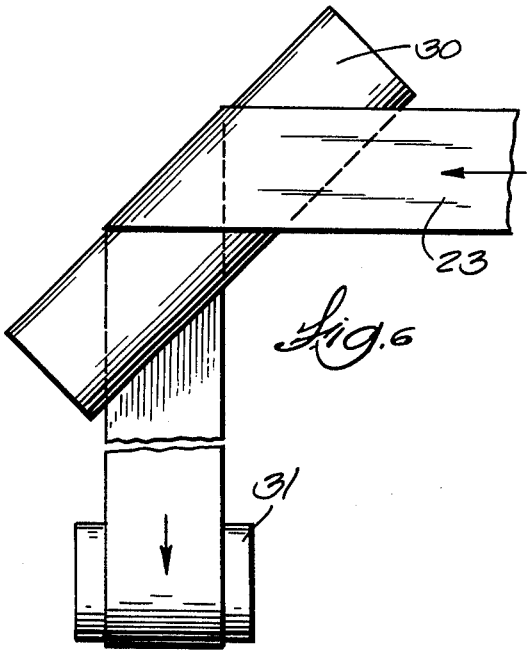
Figure 5:
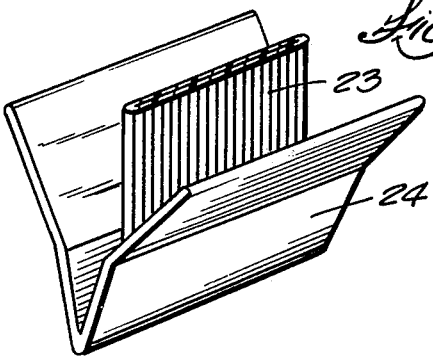
Figure 3:
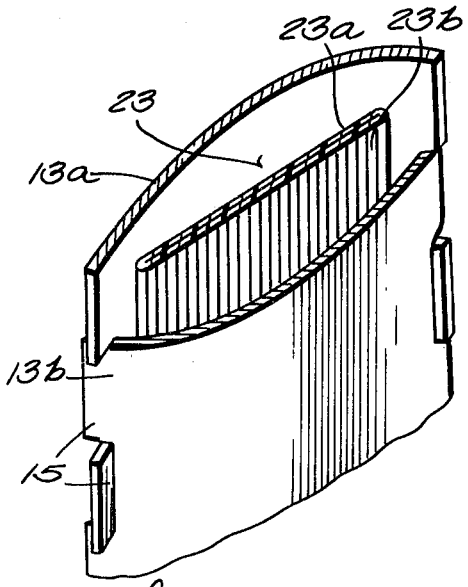
Figure 7:
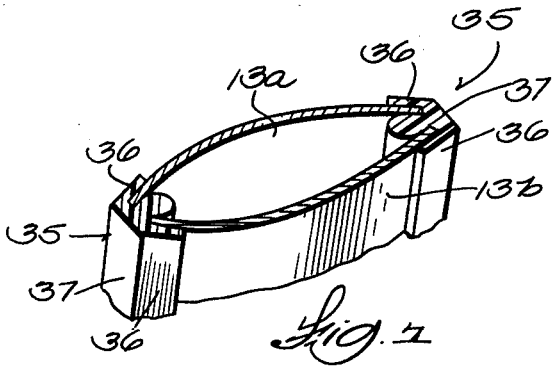

The invention will be elucidated below by reference to a drawing, showing in:

FIGS. 1 and 2 sections along line I—I of FIG. 2 and II—II of FIG. 1 resp., of a device according to the invention in the operative condition, intended for driving a drainage tape into the soil;

FIG. 3 a perspective view on a larger scale of a part of a tubular assembly according to the invention to be driven into the soil by means of such a device;

FIG. 4 a part of FIG. 2 showing the initial condition of the device according to the invention;

FIG. 5 is a perspective view on a larger scale of a shoe for anchoring a drainage tape into the soil;

FIG. 6 a top view of guiding means for the drainage tape in the device according to the invention; and FIG. 7 a perspective view corresponding to FIG. 3 of another embodiment of the tubular assembly.

The device according to the invention shown in FIGS. 1 and 2 is included in a partly shown vehicle 1. A portion 2' of the roof thereof can be lifted to the operative height shown by means of cylinders with piston rods 4, but will be lowered when driving the vehicle. A bellows 5 circumferentially joins the portion 2' and the adjacent edges of the fixed roof 2. Hydraulic jacks 6 serve to support the vehicle 1 on the soil 7 by discharging the wheel springs.

Inside the vehicle two drums **8*a* and 8*b* are juxtaposed on a common shaft 9 which is coupled to a driving means 10, in particular a hydraulic motor. The shaft 9 and motor 10 are mounted on a yoke 11 which is hingedly supported at 12 by a set of lifting rods 4**.

On each drum **8*a* and 8*b* a steel strip 13*a* and 13*b* resp. having a slightly curved cross-section is wound. The wound strip is kept together by a roller chain 14, the ends 14*a* and 14*b* of which are fixed to the yoke 11, the strips 13, by their elasticity, opposing themselves against being wound. The roller chain 14** keeps the outer diameter of the coil at a fixed value, but, during winding, the inner diameter is gradually reduced.

As appears from FIG. 3, the strips 13 are provided with laterally protruding lips 15 which are as wide as the spaces between the lips, so that two strips can be coupled together in the manner shown in FIG. 3 so as to form a flat tubular assembly. To that end both strips **18*a* and 18*b* unwound from the drums 8*a* and 8*b*** resp. are twisted about 90° and are brought into mutual engagement. It is, of course, possible to unite both strips with one another without being twisted when the drums are mounted on parallel shafts.

For guiding the strips 13 two guides are used, viz. a first guide 16 consisting of two halves **16*a* and 16*b*, and a tubular second guide 17 coaxial with the first one. In the starting position the second guide 17 is retracted upwards within the vehicle as shown in FIG. 4, and both halves 16*a* and 16*b* of the first guide are swung away laterally by means of cylinders 18 and guiding arms 19. In the operative position of FIGS. 1 and 2 the second guide 17 is lowered through a bottom sleeve 20 and is pushed into the soil 7, an end collar 21 then abutting the bottom of the vehicle 1. Then the halves 16*a* and 16*b* can be collapsed and will then bear on the collar 21. Both guides 16 and 17 have an internal shape which is adapted to the external shape of the assembly of the strips 13*a* and 13*b***, so that both strips are guided in the correct position, i.e. twisted by 90° in respect of their position when being unwound from the drums.

If, now, the strips 13 are being unwound from the drums 8, they are driven by the driving force of the drums through the guides 16 and 17 and into the soil 7, which guides drive the tubular assembly formed by said strips straight into the soil. Using a hydraulic motor 10 has the advantage that its driving force can be easily adapted to the resistance which this assembly experiences in the soil.

In some cases penetration into the soil can be facilitated by causing the assembly to vibrate. To that end a vibrator 22 is slidebly mounted on the yoke 11. This vibrator will generate a longitudinal vibration in the strips 13 having an amplitude which depends on the location of the vibrator on the yoke 11.

In the case shown the device is intended for inserting a drainage tape into the soil for making a vertical drainage. FIG. 3 shows such a tape 23, consisting of an internal relatively rigid plastic strip 23*a* with a plurality of transversely protruding longitudinal ribs, and with a flat hose or sheath 23*b* of porous sheet material surrounding this strip. When such a tape is positioned in the soil, water from the environment can penetrate into this tape, and will be discharged through the small ducts between the ribs of the strip 23*a*. The sheath prevents these ducts from getting clogged. Such a tape is known and is not a part of the present invention.

At the lower end of the tape 23 a shoe 24 according to FIG. 5 is clamped which facilitates the penetration into the soil and the anchorage of the tape in the soil. This shoe consists of a metal plate bent in a V-shape, which is fixed on the tape 23 by being pinched, and which, in particular, can be provided with internal claws or the like in order to improve the clamping. On top of the shoe 24 a sleeve 25 is arranged on the strips 13 which keeps said strips together, and remains loose from the shoe 24. The lower side of the guiding tube 17 is provided with a recess 26 in which the sleeve 25 in the retracted position of FIG. 1 will fit.

In the starting position according to FIG. 4, in which the sleeve 25 is positioned within the recess 26, a shoe 24 is clamped on the protruding part of the tape 23 by means of a hydraulic press with cylinders 27 and pressing dies 28. Subsequently the tube 17 is pressed into the soil, and the first guide 16 is closed. The upper sides of the halves 16*a* and 16*b* of this first guide are somewhat bevelled in order to facilitate the twisted insertion of the strips 13.

The tape 23 is unwound from a rotatably supported reel or drum, and is, as shown in FIG. 6, guided on guiding rollers 30 and 31, the latter one being situated between the strips 13*a* and 13*b* above the guide 16. The tape 23 is introduced, in this manner, in the correct position between both strips 13 before these strips are brought into engagement with one another. The roller 30 can, if required, be heated in order to increase the flexibility of the tape.

The shoe 24 is taken along with the strips 13, and pulls the tape 23 with it. As soon as the largest depth is reached, the strips 13 are retracted by rewinding them on the drums 8, but the shoe 24 remains stuck in the soil, so that the tape 23 is not retracted. When, finally, the sleeve 25 reaches the recess 26, and after swinging back the halves 16*a* and 16*b*, the tube 17 can be pulled upwards by it. The tape 23 can be cut off then, and, subsequently, can be provided with a new shoe 24.

Since the tape 23 is to be cut off at the soil surface, and the operator 32 is sitting in the manner shown in FIG. 1 near the guiding sleeve 20 in the vehicle, cutting off near the soil surface will be difficult. It is, of course, possible to cut off the tape below the retracted tube 17 and to remove the parts protruding from the soil later, but this is not economic.

In order to avoid this draw-back, a counting wheel 33 of a pre-settable counter can be brought into contact with the tape 23, which counter can actuate a scoring knife 34 as soon as a pre-set length of the tape has passed. This scoring knife 34 does not cut through the tape, but weakens this tape so that by starting a jerklike pulling force on the tape the latter is broken in that point. The setting of the counter is chosen in such a manner that this breaking point at the end of the pressing step has reached the height of the soil surface. When retracting the tape it will be torn in the desired point, and the tape can be retracted somewhat for fixing the shoe to it. It is, then, also possible to break the tape below the soil surface if desired.

FIG. 7 shows another manner for uniting strips 13*a* and 13*b*, viz. by means of plastic strips 35 each comprising two resilient lips 36 and a solid core 37. These strips are unwound from one or two additional reels, and the various strips are united in the manner shown in FIG. 7 by means of an appropriate guiding piece or die. After being retracted from the soil, the strips will be separated again so as to be individually rewound. The plastic strips 35 are shaped in such a manner that a substantially water-tight connection is obtained.

Instead of using two juxtaposed drums 8*a* and 8*b* as shown in FIGS. 1 and 2, it is also possible to use two drums with parallel axes so that it is no longer required to twist the strips 13, if the latter are wound with the convex side directed to the drum in question, which is possible when using a sufficiently flexible steel. Because of the fact that twisting is no longer necessary, the distance between the drums 8 and the upper end of the guides 16 and 17 can be smaller, and in some instances it will be possible to use a closed roof 2 without the lifting devices 3 and 4.

Furthermore, instead of the vibrator 22, another vibrator can be used consisting of two elements which are mounted on or near the sleeve 25, which vibrator is in particular of the pneumatic or hydraulic type. Cables or ducts for providing energy to the vibrator elements can be led through the inner space between the strips 13. Since these vibrator elements will protrude sideways from the assembled strips 13, more soil will be displaced than necessary for allowing the strips to pass through the soil, so that friction and adhesion forces of the soil on these strips will be reduced. Moreover the soil pressure on these strips will be reduced, so that they will remain more convex.

The use of the compact assembly decribed above, which may be mounted in a simple manner in a vehicle, will considerably accelerate the insertion of such drainage tapes into the soil, since this vehicle can be moved much more quickly than a driving rig, and it is no longer necessary to use the difficultly to be manipulated long tubes. It becomes also possible to insert such drainage tape horizontally into the soil, e.g. from the waterside of a canal, ditch or the like, and then the driving drums may be suspended from a crane boom or may be supported at the desired height in another manner. This is not possible with the known devices, since the space for inserting the long tubes fails.

Besides for the described purpose such a device can be used also for other purposes. Instead of the shoe 24 or the sleeve 25 a soil sounding probe, for example, can be fixed to the strips 13, and the measuring cable can be led through the inner space between these strips upwards where this cable is connected to measuring apparatus. In this manner it is possible to perform soundings at a large depth without, as required with the current methods, to couple or remove extension tubes.

It is also possible to use such a device for cutting a soil sample, in which case the sleeve 25 can be shaped as a cutting mouth. When retracting the tubular assembly 13, the soil sample can be pushed into a take-up tube when the strips 13*a* and 13*b* are pulled apart again.

The assembly according to the invention can, in general, be used for inserting any objects, in particular non-rigid elongated bodies such as cables or the like, into the soil.

The method described above can also be performed under water, and then the complete drive means can be arranged on the waterbottom, in particular since it is not necessary to use extension tubes, the coupling of which would cause difficulties under water.

It will be clear, furthermore, that the described device can be modified in many ways. It is, for instance, possible to work with more than two strips 13 and/or with more strongly curved strips 13, in particular for sample cutting, when a less flatterned tubular assembly is desired. Of course other means for guiding this assembly may be used. Moreover it may be favourable to provide the lower end of the tube 17 near the recess 26 with axial incisions in order to allow soil taken along during retracting the tube to emerge therefrom.

When introducing the drainage tapes into soil which is partly frozen, for instance in the case of marshes in very cold regions which, in summer, do not thaw at a given depth, it may be favourable to provide the tape with electrical heating elements or to take such elements along with the tape, which elements are adapted to keep the temperature in the vicinity of the tape above the freezing temperature, so as to avoid clogging of the pores thereof by ice.

I claim:

1. The method of driving a tube into the soil and pulling the tube from the soil comprising the steps of, forming a tube from a plurality of strips of longitudinally flexible material each of which strips is separately coiled and is characterized by assuming a bowed cross section when relaxed and has substantial rigidity when under tension or compression and its longitudinal edges restrained, releasably connecting the adjacent edges of said strips, forcing the tube through a rigid guide to the soil by application of axial force on the tube, the soil serving to laterally support the tube below grade, and withdrawing the tube from the soil while disconnecting the edges of the strips and winding the strips back on their respective coils.

2. A method of taking a soil sample through use of the method of claim 1 in which the soil is cored by the open end of the tube as the tube is forced into the soil and the core is removed from the space between the strips after the strips are separated as the tube is pulled from the soil.

3. The method of inserting a member into the soil utilizing the method of claim 1 further characterized by connecting the end of the member to the proximity of the end of the tube being driven into the soil and feeding the member into the space between the strips at a point prior to connection of the edges of the strips.

4. The method of claim 3 in which the member is withdrawn with the tube.

5. The method of claim 3 in which the member is connected to a driving point releasably fixed on the end of the tube whereby the point and the lower end of the member remain in the soil as the tube is withdrawn.

6. The method of claim 5 in which the member is flexible and is fed into the tube from a separate supply and the entire length of the flexible member from the surface of the soil to the lowest point to which the point is driven remains in the soil.

7. Apparatus for forming a tubular assembly and driving the assembly into soil, comprising.

a frame a plurality of separate coils mounted on the frame and each being a strip material having a bowed cross-section when unrestrained and which can be coiled flat and which is substantially rigid when under tension or compression with its longitudinal edges restrained, guide means mounted on the frame for movement to a position engaging the soil, means for driving the strips from each coil through said guide means to position the material to form a tubular assembly, means for interconnecting the adjacent longitudinal edges of the strips to form a tubular assembly, said driving means applying axial force to the strips and the tubular assembly, said guide means restraining the tubular assembly against buckling above grade and the soil acting to prevent buckling of the assembly below grade, and means for winding the strips back onto the coils.

8. Apparatus according to claim 7 including means for feeding a flexible member between the strips prior to formation of the tubular assembly, said flexible member being connected to the lower portion of the tubular assembly for insertion into the soil inside the tubular assembly.

9. Apparatus according to claim 8 in which the flexible member is connected to the lower portion of the tubular assembly by means of a driving point releasably connected to the lower end of the tubular assembly for retention in the soil when the tubular assembly is pulled from the soil.

10. Apparatus according to claim 7 in which the driving means and the winding means are the same and comprise a motor rotating each coil.

11. Apparatus according to claim 10 including means for vibrating the strips longitudinally while driving the strips into the soil.

12. Apparatus according to claim 7 including a roller chain located around each coil to limit the unwinding tendency of the strip wound on the coil by reason of the elasticity of the strip whereby the outer wrap of each strip bears against the associated roller chain.

13. Apparatus according to claim 7 in which the guide means comprises a tube supported by said frame.

14. Apparatus according to claim 13 in which the guide tube is longitudinally moveable to project the lower end of the tube into the soil.

15. Apparatus according to claim 14 including additional guide means mounted on the frame for movement from a laterally displaced position to a position above and aligned with the guide tube after the guide tube has been lowered to engage the soil.

16. Apparatus according to claim 15 in which the additional guide means comprises complimentary halves which are brought together to form a tubular guide.

17. Apparatus according to claim 7 in which the means for interconnecting the edges of the strips comprises flexible strips provided with grooves into which the lateral edges of the bowed strip material are inserted.

18. Apparatus according to claim 7 including another coil mounted on the frame, drainage tape wound on said other coil, means for introducing the tape into the tubular assembly, means for attaching the tape to the lower end of the tubular assembly.

19. Apparatus according to claim 18 including a driving point affixed to the distal end of the tape below the lower end of the tubular assembly and larger than the tubular assembly whereby the point is retained in the soil as the tubular assembly is withdrawn.

20. Apparatus according to claim 19 in which the point is a metal plate formed in a V, and means on the frame for closing the lower portion of the V on the tape.

21. Apparatus according to claim 19 including a counter for measuring the tape fed from said other coil, and means for weakening the tape at a selected point permitting the tape to be torn at that point when the tape has been inserted into the soil to the desired depth.

* * * * *